United States Patent [19]

Tucker et al.

[11] Patent Number: 4,584,946

[45] Date of Patent: Apr. 29, 1986

[54] FOLDING TABLE SYSTEM

[76] Inventors: Charles L. Tucker; Donna T. Tucker, both of 2609 Bunker Hill Rd., Woodstock, Md. 21163

[21] Appl. No.: 651,687

[22] Filed: Sep. 18, 1984

[51] Int. Cl.[4] ..... A47B 37/04

[52] U.S. Cl. ..... 108/50; 108/128

[58] Field of Search ..... 108/128, 50; 248/435, 248/434, 155.2, 155.3

[56] References Cited

U.S. PATENT DOCUMENTS

| | | | |
|---|---|---|---|
| 1,449,023 | 3/1923 | Wardle | 248/435 |
| 2,039,805 | 5/1936 | Knight | 108/128 X |
| 2,445,489 | 7/1948 | Mangold | 108/128 X |
| 2,454,202 | 11/1948 | Pierik | 108/50 |
| 2,743,146 | 4/1956 | Wheeler | 108/50 |
| 2,785,735 | 3/1957 | Banks | 108/128 |
| 2,905,513 | 9/1959 | Kane | 108/128 |
| 3,215,095 | 11/1965 | Keppeler | 108/50 |
| 3,730,587 | 5/1973 | Bloxham et al. | 248/435 |
| 3,782,435 | 1/1974 | Sherman | 108/50 |
| 3,960,092 | 6/1976 | Levkovski | 108/128 |

*Primary Examiner*—Francis K. Zugel

*Attorney, Agent, or Firm*—John F. McClellan, Sr.

[57] ABSTRACT

A folding table especially adapted for use with a central pole supporting it, as under a beach umbrella, has a central hub with provision for detachably mounting at any desired level on a pole and a radial array of spokes pivotally mounted on the hub and supporting as a table surface, a disk of flexible material. In use position the spokes are radially deployed and rest against an annular flange of the hub, where a nut on a threaded coaxial portion of the hub holds them. The hub can be mounted so that the spokes fold upward for storage, or the hub can be inverted so that the spokes fold downward for storage. In folded position the table can easily be carried separate from or with a pole. The table surface or disk of flexible material can be easily removed and replaced with the spokes in folded position.

3 Claims, 9 Drawing Figures

FOLDING TABLE SYSTEM

FIELD OF THE INVENTION

This invention relates generally to tables and particularly to a folding table adapted for use on a substantially upright pole of a beach umbrella and the like.

BACKGROUND OF THE INVENTION

On a beach the place to set down a drink, food, suntan oil, cigarettes, keys, money, rings, watches, clothing, fresh towels and other personal items, is usually on the sand on a beach towel. Loss, damage and inconvenience result when the beach towel is moved or someone lies on or kicks the items set down on the beach towel. A stable table, when available, can be most convenient and satisfactory as a solution to this problem.

Beach umbrellas are usually available to rent but not tables.

PRIOR ART

In prior art devices pertinent to the field of this invention, the following U.S. patent disclosures are known:

U.S. Pat. No. 1,173,665 to J. Jakab, Feb. 29, 1916, disclosed a folding table for an umbrella pole;

U.S. Pat. No. 1,551,198 to F. D. Norton, Aug. 25, 1925 disclosed a collapsible grate with radial arms extending from a central leg;

U.S. Pat. No. 2,039,805 to R. J. Knight, May 5, 1936, disclosed a beach umbrella table with a clamp for the pole and a set of radial ribs or arms that can fold. The table top is made of fabric, canvas or other suitable material;

U.S. Pat. No. 2,799,543 to L. A. Tomaselli, July 16, 1957, disclosed a folding table clamped on an umbrella type pipe; U.S. Pat. No. 3,295,473 to J. R. Wentworth, Jan. 3, 1967, disclosed a multi-element table for an umbrella;

U.S. Pat. No. 3,683,825 to M. Sheldon, Aug. 15, 1972, disclosed a plural-element round top in a folding table;

U.S. Pat. No. 3,782,435 to R. H. Sherman, Jan. 1, 1974, disclosed a collar adjustably engaging an umbrella shaft and carrying a set of radial arms pivoted to it. On the arms canvas or plastic is carried as a shield for a table under the umbrella.

However, none of the known devices has become a standard article of commerce for the purpose, and to provide such is a principal object of the system of invention.

Further objects of this invention are to provide an easily carried and easily installed table for mounting on a beach umbrella pole, that folds compactly both when carried on and off a beach umbrella pole.

And further objects are to provide a system as described that can be made economically, that will fit most beach umbrellas, that is stable, is durable and attractive in appearance, is lightweight, and is versatile in use and in storage positions.

BRIEF DESCRIPTION OF THE DRAWINGS

The above and other objects and advantages of this invention will become more readily apparent on examination of the following description, including the drawings in which like reference numerals refer to like parts.

DETAILED DESCRIPTION

Figure 1:
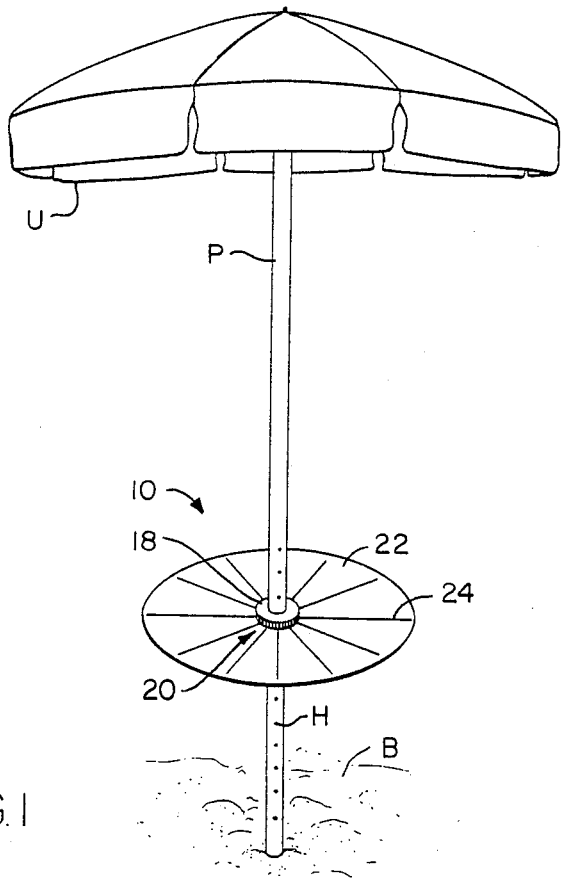
FIG. 1 is a perspective view of a preferred embodiment of the invention in use with a beach type umbrella on a beach.

FIG. 1 shows the invention in embodiment 10, a folding table in use supported on the pole P of a beach umbrella U on a beach B. The invention includes, as a system, a nut 18 on a hub 20 supporting a flexible-material member or disk 22 by means of a plurality of spokes radiating from the hub and inserted in respective blind tunnels 24 radially formed in the flexible disk 22. Height of the table may be adjustably set by a pin (not shown) inserted below the hub into one of a series of holes H in the pole. Diameter of the table may be substantially large, because of the local support of the flexible table provided by the spokes, which may number ten or more.

Figure 2:
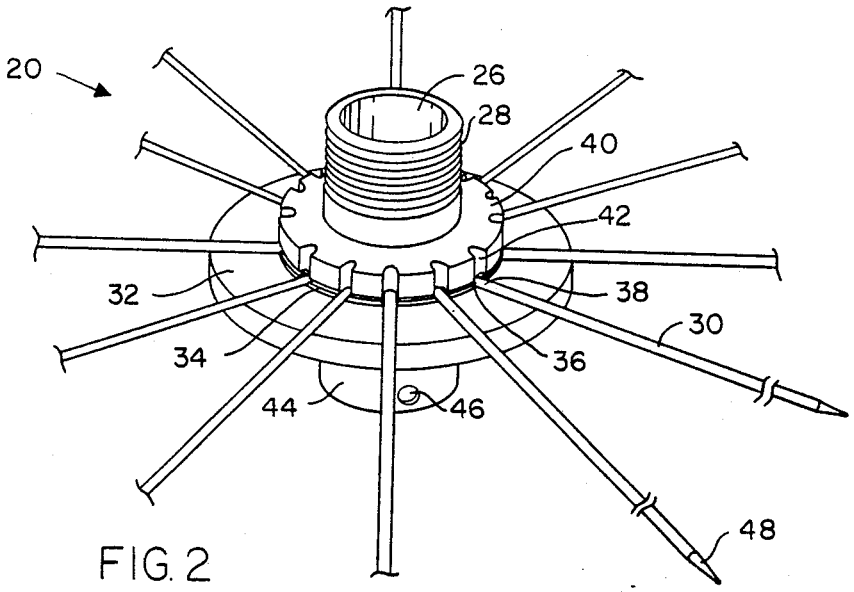
FIG. 2 is a perspective, fragmentary view of relation of spoke and hub portions of the invention.

FIG. 2 shows details of the hub 20 on assembly to other parts. The hub 20 is one-piece with axially spaced coaxial portions about a central bore 26.

Screw threaded portion 28 receives a nut (not shown) that when screwed-on reaches down and forces the spokes 30 against radial flange 32. The parts exerting this force are means for releasably affixing the spokes 30 deployed in the use-position or first position, to which they pivot about wire ring 34, that passes through a respective hole 36 in the inner end 38 of each spoke. The wire ring is means for attaching each inner end to the hub pivotally from a first position radial to the bore 26 to a second position with the spokes substantially parallel with the bore. The wire ring is held in a circumferential groove in notched shoulder 40.

The hemi-cylindrical upright or axis-parallel notches 42 in the notched shoulder are means respectively holding and stabilizing the hemispherically rounded inner ends 38 of the spokes in the deployed position. The upper portions are means for stabilizing a side portion of each spoke when the spokes are in the folded position, parallel in an up-position, in the arrangement.

The hub 20 terminates at the lower end in a tubular extension 44 that may have a hole 46 through it to receive a pin to hold the hub and a beach umbrella pole in desired adjustment.

The outer ends 48 of the spokes may be rounded or may be tapered as shown, for easier insertion in a flexible sheet material member on assembly.

Figure 3:
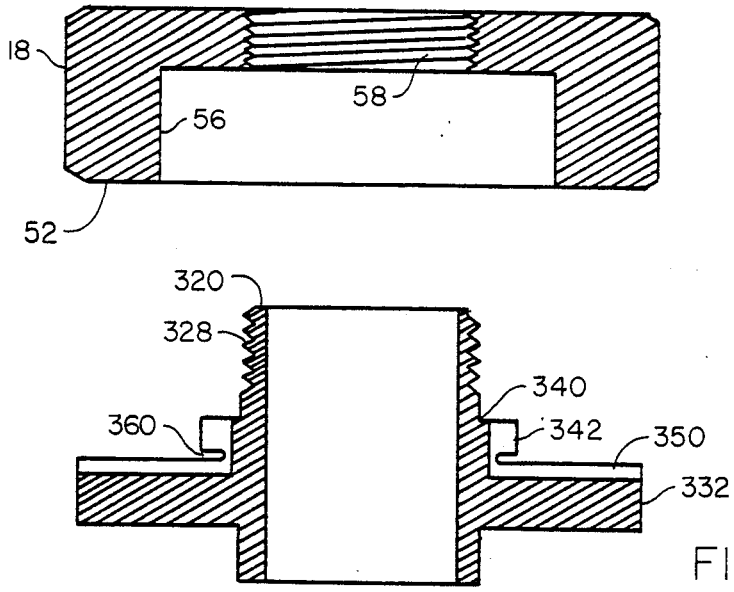
FIG. 3 is an elevational exploded sectional view showing relation of hub and a nut in a further embodiment.

FIG. 3 shows the relation of nut 18 and hub 320 in a further embodiment similar to the first embodiment except that the notches 342 in the notched shoulder 340 may continue as radially outward grooves 350 in the adjacent surface of the flange 332. Through this provision, the grooves 350 further stabilize the spokes in circumferential direction, the lip 52 of the cup-shaped nut forcing the spokes into the grooves when the nut is tightened. The grooves are preferably made in hemicylindrical shape and wide enough to accommodate the flexible material of the table, that surrounds the spokes.

In embodiments without the grooves, the coaxial relief 56 in the nub 18, when the nut is screwed on by the female threads 58 in it to the threads at 328 of the hub 320, clears the hub shoulder 340 and the lip 52 and presses and secures the spokes against the flange upper surface.

Annular recess 360 in the lower circumference of the slotted shoulder 340 holds the wire ring that pivotally secures the spokes.

Figure 4:
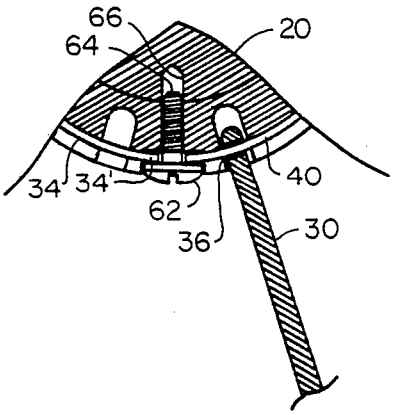
FIG. 4 is a plan detail in partial section showing assembly relations of spoke and retention of same.

FIG. 4 details how the spokes 30 are held to the hub 20 by wire ring 34 that passes through a hole 36 in each spoke. The ends 34' of the wire ring are captured against the shoulder 40 by the head 62 of a screw 64 that engages a tapped hole 66 radially in the slotted shoulder.

Figure 5:
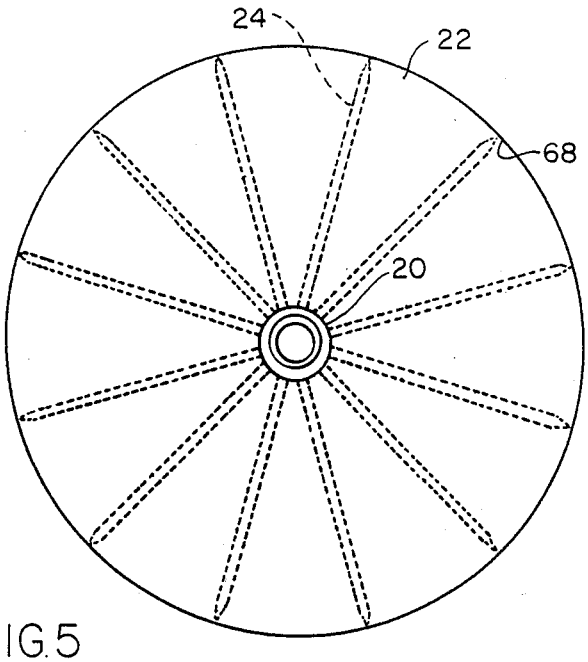
FIG. 5 is a plan view showing relation of flexible disk, when installed, to a hub.

FIG. 5 shows in plan view the deployed relation of hub 20 and flexible material 22 comprising the table surface. The flexible material 22 is preferably heavy gauge vinyl, fabric reinforced, or it may be canvas or other suitable material, wrinkle resistant and capable of holding the circular shape, preferably.

A radial tunnel 24 is sewn or otherwise formed in the flexible material, for each spoke. The tunnels stop short of the outer perimeter, leaving a closed-rim or margin 68 that guards the outer ends of the spokes.

Figure 6:
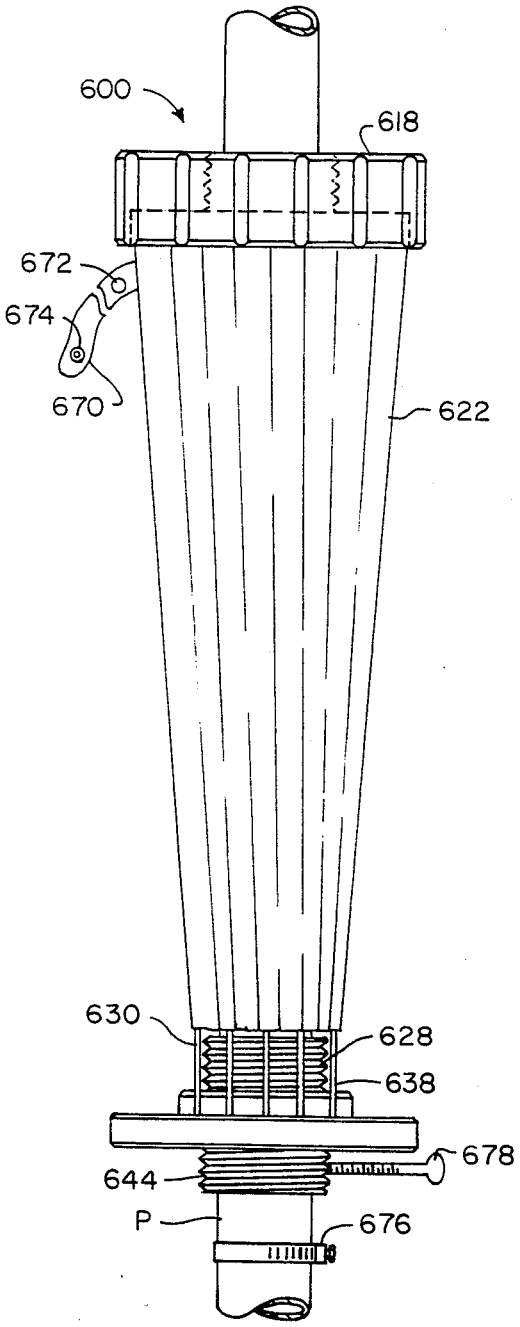
FIG. 6 is an elevational view of an embodiment in a folded mode, in place on a beach umbrella pole with two indicated provisions usable for location along the pole, and provision for maintaining the folded mode.

FIG. 6 diagrams several provisions in an embodiment 600, shown in upwardly folded configuration. The nut 618 may be used to hold the upper ends of the spokes and the flexible material 622 on them in compact upwardly folded mode. When it is desired to deploy the table for use, it is instantly made ready by lifting the nut 618 to let the table fall into disk shape, and then screwing the nut on the hub threads 628 to hold it there.

Alternatively, a band 670 secured at one end to the flexible fabric 622 may have snaps 672, 674 that engage each other like those of an umbrella band, and be used to hold the table in folded position. In this case, when the folding table is removed from the pole, the nut 618 may be retained by screwing it on threaded tubular lower end 644 of the hub, which is means for storing it.

With the spokes 630 in the upward or parallel position shown, the flexible material 622 can be slid off the spokes for cleaning or replacement, or on to them for assembly, as desired. Also, in this position, rain or other moisture can drain off the flexible fabric past the inner ends 638 of the spokes.

To hold the folding table 600 at a desired level, a hose clamp 676 may be applied to the pole P below the folding table. Alternatively, a thumb screw 678 may be threaded through a tapped hole into the bore and tightened against the pole.

Figure 7:
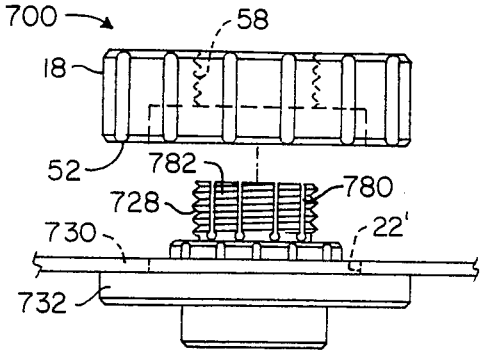
FIG. 7 is an elevational exploded detail of a further embodiment, with the table provision deployed in use-position.

FIG. 7 shows a further embodiment 700 which has a provision for combining in one operation the steps necessary (1) to secure the folding table assembly to a pole at desired height and (2) to lock the folding table in deployed mode. For this, tubular threaded portion 728 of the hub has through it a plurality of axial slots 780 spaced around it, dividing it into tongues 782. When the nut is applied, the slope of the preferably "V" threads 58 in the nut engages those of the tubular threaded portion and forces the tongues 782 to hold against the pole. At the same time, the lip 52 of the tightened nut 18 descends and grips the flexible material covered spokes 730 between it and the hub flange 732. The broken lines 221 indicate the inner perimeter of the flexible material. When this is gripped by the nut as noted, this is means enabling the tablelike surface further to resist radial forces.

Figure 8:
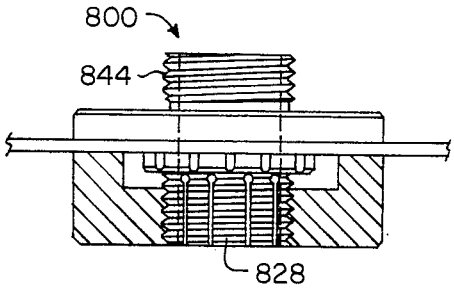
FIG. 8 is a view similar to that of FIG. 7, but of a further embodiment.
Figure 9:
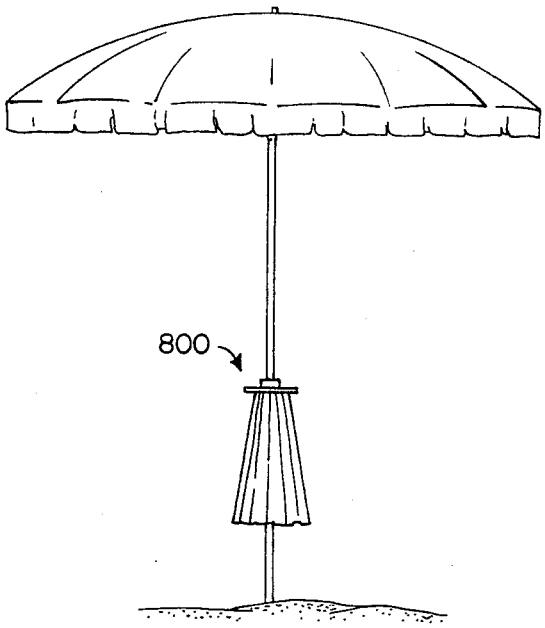
FIG. 9 is an elevational view showing an embodiment in a downwardly folded mode on a beach umbrella.

FIGS. 8 and 9 show how any embodiment of the folding table, 800 shown, can fold down if installed inverted. The flexible material can be removed from the spokes and cleaned while still on the pole, if desired. In this embodiment, a split threaded portion 828, similar to that described in reference to the previous Figure, is combined with the nutstorage threads 844 used when the embodiment is removed from the folding table and carried, or stored.

Material for the hub may be any suitable thermoplastic such as high density polyethylene, or polystyrene. The spokes may be the same or may be of aluminum or other suitable material, even wood. A suitable diameter in a metal version for a spoke-length of 12 inches (30 cm) has been found to be 3/16 inch (0.5 cm). The bore may be 1 13/16 diameter (3 cm) and the nut and matching flange may be about 4 inches (10 cm) in diameter.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a system of folding table having a portion with means for engaging a pole of the type used substantially upright in supporting beach umbrellas, the improvement comprising: the means for engaging a pole including a hub with a bore for receiving a pole, a plurality of spokes with inner and outer ends, means for attaching each inner end to the hub pivotally from a first position with the spokes radial to the bore to a second position with the spokes upward substantially parallel with the bore, a flexible-material member supported by the plurality of spokes and forming a disc shaped table-like surface with the plurality of spokes in said first position, means for releasibly affixing the plurality of spokes in said first position and means for releasibly affixing the plurality of spokes in said second position, the means for releasibly affixing the plurality of spokes in said first position comprising a threaded portion on the hub, a radial flange on the hub adjacent the threaded portion, a nut proportioned for screwing onto the threaded portion on the hub and clamping the plurality of spokes between the nut and the radial flange and means for resisting radial forces on the disc shaped table-like surface, including the flexible material member having an inner perimeter and said inner perimeter being clamped by the nut when the nut clamps the plurality of spokes, means for stabilizing the plurality of spokes when affixed in said first position comprising the flange having structure defining a plurality of radial grooves therein in position for receiving a portion of said plurality of spokes when clamped, means for stabilizing the plurality of spokes when affixed in said second position, comprising the hub having therein structure defining a plurality of notches parallel with the bore in position for receiving a portion of said plurality of spokes when in said second position, said flexible material member supported by the plurality of spokes including the plurality of spokes being within respective tunnels in the flexible-material member, and said flexible-material member being in the shape of a disk with a closed margin around the outer periphery guarding the outer ends of the spokes.

2. In a system as recited in claim 1, means including a threaded tubular lower end on the hub for storing the nut on the hub when the folding table is removed from the pole.

3. In a system as recited in claim 1, the means for engaging a pole further comprising the threaded portion having structure defining a plurality of slots therein leaving tongue-like portions between the slots, the nut having proportions such that when the nut is tightened on the threaded portion the tongue-like portions will deflect into the bore for gripping a pole as the nut accomplishes said clamping of the plurality of spokes.

* * * * *